US010640729B2

(12) United States Patent
Kozyuk et al.

(10) Patent No.: US 10,640,729 B2
(45) Date of Patent: May 5, 2020

(54) METHODS FOR REDUCING SOAP FORMATION DURING VEGETABLE OIL REFINING

(71) Applicant: Arisdyne Systems, Inc., Cleveland, OH (US)

(72) Inventors: Oleg Kozyuk, North Ridgeville, OH (US); Peter Reimers, Shaker Heights, OH (US)

( * ) Notice: Subject to any disclaimer, the term of this patent is extended or adjusted under 35 U.S.C. 154(b) by 0 days.

(21) Appl. No.: 16/288,353

(22) Filed: Feb. 28, 2019

(65) Prior Publication Data

US 2019/0292487 A1 Sep. 26, 2019

Related U.S. Application Data

(60) Provisional application No. 62/646,224, filed on Mar. 21, 2018.

(51) Int. Cl.

| | |
|---|---|
| ***C11B 3/06*** | (2006.01) |
| ***C11B 3/00*** | (2006.01) |
| ***C11B 3/16*** | (2006.01) |

(52) U.S. Cl.

CPC ..... *C11B 3/06* (2013.01); *C11B 3/001* (2013.01); *C11B 3/16* (2013.01)

(58) Field of Classification Search

CPC ..... C11B 3/06; C11B 3/001; C11B 3/16

USPC ..... 554/196

See application file for complete search history.

(56) References Cited

U.S. PATENT DOCUMENTS

| | | | | |
|---|---|---|---|---|
| 8,911,808 | B2 | 12/2014 | Gordon et al. | |
| 8,945,644 | B2 | 2/2015 | Gordon et al. | |
| 9,290,717 | B1 | 3/2016 | Kozyuk et al. | |
| 9,321,983 | B2 | 4/2016 | Kozyuk | |
| 9,340,749 | B1 | 5/2016 | Kozyuk et al. | |
| 9,410,109 | B1 | 8/2016 | Kozyuk | |
| 9,453,180 | B2 | 9/2016 | Kozyuk et al. | |
| 9,556,399 | B2 | 1/2017 | Kozyuk et al. | |
| 9,765,279 | B2 | 9/2017 | Kozyuk et al. | |
| 9,845,442 | B2 | 12/2017 | Kozyuk et al. | |
| 2007/0134777 | A1 | 6/2007 | Dayton et al. | |
| 2016/0108338 | A1 | 4/2016 | Kozyuk et al. | |
| 2017/0204349 | A1* | 7/2017 | Kozyuk | C11B 3/005 |
| 2018/0340132 | A1 | 11/2018 | Kozyuk et al. | |

FOREIGN PATENT DOCUMENTS

| | | |
|---|---|---|
| WO | 200031219 | 6/2000 |
| WO | 2016060656 | 4/2016 |

OTHER PUBLICATIONS

International Search Report and Written Opinion issued in corresponding International Patent Application No. PCT/US2019/019958; dated Jun. 13, 2019.

* cited by examiner

*Primary Examiner* — Deborah D Carr

(57) ABSTRACT

A method for refining vegetable oil is used to reduce formation of soaps. An acid-treated vegetable oil mixture is passed through a low shear mixing device prior to being fed to an static hydrodynamic reactor. The static hydrodynamic reactor induces a neutralization reaction that forms soaps in a pressurized vegetable oil mixture. The reacted mixture is discharged from the reactor to a downstream system for separating the formed soaps from the reacted mixture to form a refined vegetable oil having reduced soaps content.

20 Claims, No Drawings

METHODS FOR REDUCING SOAP FORMATION DURING VEGETABLE OIL REFINING

This application claims the benefit of U.S. provisional application Ser. No. 62/646,224 filed Mar. 21, 2018, the contents of which are incorporated herein in their entirety by reference.

FIELD

This invention relates to methods for refining oils and, in particular, to neutralization methods for reducing soapstock formation during a neutralization step of a vegetable oil refining process.

BACKGROUND

Vegetable oils are typically oils that have been pressed or extracted, such as from a vegetable source. Many vegetable oils contain some form of phosphatides (e.g., hydratable or non-hydratable), commonly known as gums. For instance, soybean oil contains about 1-3%, corn oil 0.6-0.9%, sunflower oil 0.5-0.9%, and canola oil (crude) 1-3% of gums.

The primary components to be removed during vegetable oil refining (degumming) are free fatty acids (FFAs) and phospholipids contained in the oil. Such components are usually removed by applying an acid treatment and caustic soda treatment in an oil neutralization step. Neutralization is an important step in the chemical refining of vegetable oils for removing FFAs. Traditionally, FFAs are treated with caustic soda (NaOH). The neutralization reaction produces soaps or soapstock which are separated from the oil to form a purified oil product.

In addition to the formation of soapstock being a drawback, separation of the soapstock can result in oil losses. For instance, FFAs are generally removed during neutralization as sodium soaps, but desirable neutral oil is also entrapped in the emulsion formed during the neutralization process due to the soapstock's emulsifying effect. The trapped neutral oil is removed along with the soap during centrifugation.

Some improvements have been introduced in oil treatment processes. Improved mixing of chemicals during caustic soda and acid treatment using hydrodynamic cavitation reactors, high-pressure valve type homogenizers, and compression-decompression devices have been suggested to lower consumption of acids and alkali, and to improve the efficiency and oil yields in vegetable oil refining processes. Such processes can be found in, for example, U.S. Pat. Nos. 8,911,808; 8,945,644; 9,410,109; 9,453,180; 9,556,399; 9,765,279 and 9,845,442.

To reduce separation losses, the process design should minimize production soapstock during the neutralization operation. The present invention provides solutions for improving oil degumming processes that overcome the disadvantages of soapstock formation.

SUMMARY

In a first aspect, there is a method for reducing soap formation during refining of a vegetable oil, the method includes mixing an acid-treated vegetable oil with a base to neutralize free fatty acid and acid in the acid-treated vegetable oil to form a pretreated mixture; passing the pretreated mixture through a low-shear pump to increase pressure in the pretreated mixture to form a pressurized pretreated mixture; and passing the pressurized pretreated mixture through a static hydrodynamic reactor to induce a neutralization reaction in the pressurized pretreated mixture.

In an example of aspect 1, the low-shear pump is a reciprocating positive displacement pump, a piston pump, a plunger pump or a diaphragm pump.

In another example of aspect 1, the static hydrodynamic reactor is a high-pressure jet nozzle, a static mixer, a high-pressure valve type homogenizer, a hydrodynamic cavitation reactor or a compression-decompression device.

In another example of aspect 1, the acid-treated vegetable oil is an acid-treated crude vegetable oil or an acid-treated water-degummed vegetable oil.

In another example of aspect 1, the acid in the acid-treated vegetable oil is phosphoric acid, hydrochloric acid, sulfuric acid, ascorbic acid, acetic acid, citric acid, fumaric acid, maleic acid, tartaric acid, succinic acid, glycolic acid or a combination thereof.

In another example of aspect 1, the base is an aqueous base selected from sodium hydroxide, potassium hydroxide, sodium silicate, sodium carbonate, calcium carbonate or a combination thereof.

In another example of aspect 1, the vegetable oil in the acid-treated vegetable oil is acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil or a combination thereof.

In another example of aspect 1, the acid-treated vegetable oil is at a temperature in the range of 50 to 100° C.

In another example of aspect 1, the static hydrodynamic reactor is an inline device.

In another example of aspect 1, the static hydrodynamic reactor is a static hydrodynamic cavitation reactor having one or more local constrictions, for example, an orifice.

In another example of aspect 1, the static hydrodynamic cavitation reactor includes a first local constriction and a second local constriction, the first local constriction is in series with the second local constriction.

In another example of aspect 1, the neutralization reaction forms soaps in the pressurized pretreated mixture and the soaps are separated from the pressurized pretreated mixture to form a refined vegetable oil.

In another example of aspect 1, the refined vegetable oil comprises less than 200 ppm, less than 150 ppm, less than 125 ppm or less than 1000 ppm of the soaps formed by the neutralization reaction.

In a second aspect, there is a method for reducing soap formation during refining of a vegetable oil, the method includes mixing an acid-treated vegetable oil with a base to neutralize free fatty acid and acid in the acid-treated vegetable oil to form a pretreated mixture; passing the pretreated mixture through a low-shear pressurizing device to increase pressure in the pretreated mixture to form a pressurized pretreated mixture; forming a reacted mixture by passing the pressurized pretreated mixture through a two or more local constrictions in series, each local constriction generates cavitation in the pressurized pretreated mixture to induce a neutralization reaction in the pressurized pretreated mixture, the neutralization reaction forms soaps in the pressurized pretreated mixture; adding water to the reacted mixture and mixing the reacted mixture containing water for 15 minutes or more; and separating the soaps from the reacted mixture to form a refined vegetable oil, the refined vegetable oil comprising less than 200 ppm, less than 150 ppm, less than 125 ppm or less than 100 ppm of the soaps.

In an example of aspect 2, the pressurized pretreated mixture is at a temperature in the range of 50 to 100° C.

In another example of aspect 2, a static hydrodynamic cavitation reactor includes the two or more local constrictions.

In another example of aspect 2, the pressurized pretreated mixture is at a pressure of 750 psi or more upstream of the two or more local constrictions.

In another example of aspect 2, the reacted mixture that includes the water is mixed for 15 minutes or more prior to separating the soaps from the reacted mixture.

In another example of aspect 2, the low-shear pressurizing device is selected from a reciprocating positive displacement pump, a piston pump, a plunger pump and a diaphragm pump.

Any one of the above aspects (or examples of those aspects) may be provided alone or in combination with any one or more of the examples of that aspect discussed above; e.g., the first aspect may be provided alone or in combination with any one or more of the examples of the first aspect discussed above; and the second aspect may be provided alone or in combination with any one or more of the examples of the second aspect discussed above; and so-forth.

The accompanying drawing is included to provide a further understanding of principles of the disclosure, and is incorporated in and constitutes a part of this specification. The drawing illustrates some examples(s), and together with the description serves to explain, by way of example, principles and operation thereof. It is to be understood that various features disclosed in this specification and in the drawing can be used in any and all combinations. By way of non-limiting example the various features may be combined with one another as set forth in the specification, above, as aspects.

DETAILED DESCRIPTION

The terminology as set forth herein is for description of the embodiments only and should not be construed as limiting the invention as a whole. Herein, when a range such as 5-25 (or 5 to 25) is given, this means preferably 5 or more and, separately and independently, preferably 25 or less. In an example, such a range defines independently not less than 5, and separately and independently, not more than 25.

A method has been discovered for an efficient, cost-effective vegetable oil refining process that reduces the formation of soapstock or soaps during neutralization. The vegetable oil to be refined is pre-mixed with at least a reagent, e.g., an acid and water, to form a feed supply. It has been surprisingly and unexpectedly found that by using a low-shear mixing device, such as a low-shear reciprocating pump, for pressurizing the feed supply with an added base in the neutralization step can significantly reduce the amount of soaps formed in the vegetable oil. The neutralization step is preferably carried out with a static hydrodynamic reactor for inducing the neutralization reaction that forms the undesirable soaps in the vegetable oil. A decrease in the amount of soaps formed during vegetable oil refining can reduce the amount of oil loss and the costs related to separating and purifying the refined vegetable oil product. As such, an overall decrease in the amount of soaps in the refined vegetable oil can be achieved by the methods of this disclosure while improving efficiency and reducing costs.

In one or more embodiments, a method for refining vegetable oil that includes reducing soap formation during neutralization can include multiple stages. Methods can include pipes, hoses, or other conventional, industrial equipment to facilitate the fluid communication of the elements and streams discussed below.

The oils that can be refined include vegetable oils, such as crude vegetable oil or water-degummed oil. Examples of vegetable oils can include, for example, acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil or combinations thereof.

The phosphatide or phosphorus content of the vegetable oil can be in the range of 30 to 3,000 ppm, 100 to 1,000 ppm, 200 to 800 ppm or 300 to 600 ppm. The phosphatide content (or also referred to as phospholipid content), as used herein, is expressed as ppm phosphorus in oil. In an example, the phosphatide content of crude oil, such as vegetable crude oil, can be in the range of 200 to 1,200 ppm phosphorus or as noted above. In another example, the phosphatide content of previously water-degummed oil, such as water-degummed vegetable oil, can be in the range of 30 to 200 ppm or 50 to 150 ppm phosphorus. A crud vegetable oil can have a phosphorous content in the range of 200 to 3,000.

The vegetable oil can be optionally heated prior to processing and neutralization, such as prior to acid being added to form an acid-treated vegetable oil. For example, the oil can be passed through a heat exchanger, such as a plate and frame heat exchanger, to increase or decrease the temperature of the vegetable oil as desired. The vegetable oil can be heated to a temperature in the range of 20 to 100° C., or at least to 30, 40, 50, 60, 70, 80, 90 or 100° C. Preferably, the vegetable oil is maintained at a temperature in the range of 40 to 95° C. during the refining process as deemed suitable to one skilled in the art.

To form the acid-treated vegetable oil, acid is added to the vegetable oil. Acid is preferably added to the vegetable oil under stirring conditions, for example, in a vessel or tank equipped with a mixer or agitator. Mixing of the vegetable oil and the acid can be for a period of time in the range of 15 minutes to 2 hours, or 30 minutes to 1 hour.

The acid can include an inorganic or organic acid, for example, phosphoric acid, hydrochloric acid, sulfuric acid, ascorbic acid, acetic acid, citric acid, fumaric acid, maleic acid, tartaric acid, succinic acid, glycolic acid or a combination or mixture thereof. The acid is used in range from about 50 to 1,000 ppm as measured by weight of the vegetable oil. For example, a high concentration acid in water solution can be used, such as a 75 to 85 weight percent phosphoric acid water solution. In another example, the acid can be used in range from at least 0.02 to 0.4 percent by weight based on total weight of the vegetable oil. Concentrated acid solutions, for instance, between 50 and 90 weight percent, can be used to reduce the amount of volume of acid solution being added. The pH adjuster reagent (i.e. acid) can be stored in a working or holding tank prior to being added to the vegetable oil.

A base, such as in an aqueous base solution, can be added to and mixed with the vegetable oil, for example, the acid-treated vegetable oil, to form a pretreated mixture. The base can be added to neutralize the vegetable oil, for instance, to bring the pH of the mixture to a range of 5 to 8, and preferably 6 to 7. The base can promote the neutralization of free fatty acids and added acid contained in the vegetable oil. The base can be stored in a working or holding tank prior to being added to the acid-treated vegetable oil.

The base can include sodium hydroxide, potassium hydroxide, sodium silicate, sodium carbonate, calcium carbonate, or combinations thereof. The base can be used in range from at least 0.02 to 0.2 percent by weight based on total weight of the vegetable oil. In another example, the base can be used in the range from 0.2 to 1 ppm base by weight based on the total weight of the vegetable oil, for instance, in the acid-treated vegetable oil stream. Concentrated base solutions, for instance, between 30 and 80 weight percent, can be used to reduce the amount of volume of base solution being added. Optionally, dilute solutions of base, for example 40 to 75 weight percent, can be used. Beyond the stoichiometric amount of base required to neutralize the acid and free fatty acids in the vegetable oil, surplus base can be added, for example, to adjust for certain vegetable oils to be refined and the quality thereof.

The pretreated mixture, for example, having a temperature in the range 50 to 100° C., can be passed through a low-shear pressurizing device to increase the pressure in the mixture and form a pressurized pretreated mixture. In one embodiment, the pressure in the pretreated mixture is elevated by passing it through a low-shear pump (e.g., a low-shear reciprocating pump) to form a pressurized pretreated mixture. Reciprocating pumps are regarded as low-shear pumps, as in principle they transfer fluids in and out of a chamber with the help of check valves. The fluid flow experiences local low shear when passing through these pumps. Shear is defined as relative motion between adjacent layers of a moving liquid. The low-shear reciprocating pump can be selected from, for example, a piston, plunger, or diaphragm pump as known in the art. In one or more embodiments, a low-shear pump can be operated at a shear rate of less than 2,500 $s^{-1}$. For example, the low-shear pump can operate at a shear rate less than 2,000, 1,500, 1,000, 750, 500, 300, 250 or 200 $s^{-1}$.

Reciprocating pumps, for example, reciprocating positive displacement pumps, use pistons, plungers, or diaphragms in order move fluid by trapping a fixed amount of fluid and forcing (displacing) that trapped volume into the discharge outlet. Reciprocating pumps are regarded as low shear pumps, as in principle they transfer fluids in and out of a chamber with the help of check valves. These valves usually resemble some sort of orifice that opens and closes during the chamber filling and discharge. The fluid flow experiences local velocity and pressure variations when passing through these restrictions to cause low shearing of the fluids.

To specify the shear rate for a reciprocating positive displacement pump the following equation can be used:

$$\text{shear rate}=V/L,$$

wherein V is the flow velocity in the gap between of displacing check valve and displacing check valve seat (m/s), and L is the size gap between the displacing check valve and displacing check valve seat (m).

The low-shear pressurizing device prevents the formation of fine emulsions in the pretreated mixture that can result in increased soap formation during the neutralization reaction in the static hydrodynamic reactor. High-shear pressurizing device, such as a centrifugal pump, can result in intense mixing of the pretreated mixture and lead to a greater amount of soaps and entrapped oil as compared to the use of the low-shear pressurizing device. High-shear refers to a shear rate of 5,000 $s^{-1}$ or more.

In another embodiment, the base is added to the acid-treated vegetable oil to form a pretreated mixture. The formed pretreated mixture is immediately passed through a low-shear reciprocating pump such that the formed pretreated mixture does not experience retention time or mixing prior to being pressurized by passing through the low-shear reciprocating pump. For example, the base can be metered into an acid-treated vegetable oil to form a pretreated mixture that is in fluid connection to the inlet of a low-shear mixing device or pump.

In forming the pressurized pretreated mixture, the pressure of the pretreated mixture can be increased to a pressure of 300 psi or more, 400 psi or more, 500 psi or more or 600 psi or more. In another example, the pressure of the resulting pressurized pretreated mixture can be in the range of 200 to 1,500 psi, 250 to 1,000 psi or 300 to 800 psi, or at least 250, 300, 400, 500, 600, 700 or 800 psi. To achieve the desired pressure, the pretreated mixture can be passed through a low-shear pump multiple time, for example, 2, 3, 4 or 5 passes. In another example, two or more low-shear pumps can be arranged in series to achieve the desired pressure in the pressurized pretreated mixture prior to being passed through a reactor to induce a neutralization reaction in the vegetable oil.

The pressurized pretreated mixture is passed through a static hydrodynamic reactor to induce a neutralization reaction in the mixture. The static hydrodynamic reactor has an inlet and an outlet. As the pressurized pretreated mixture passes through the static hydrodynamic reactor, a reacted mixture is formed and discharged from the reactor through its outlet. Preferably, the reacted mixture promotes and induces a neutralization reaction, which can form soaps in the reacted mixture.

In one or embodiments, the outlet of the low-shear pump can be in direct connection with the inlet of the static hydrodynamic reactor. Static hydrodynamic reactors can be selected from, for example, a high-pressure jet nozzles, static mixers, high-pressure valve type homogenizers, hydrodynamic cavitation reactors (e.g., having a static local constriction (orifice, baffle, nozzle, etc.) and compression-decompression devices (e.g., that avoid formation of cavitation bubbles). A wide variety of devices are suitable to perform the improved neutralization method steps provided herein. For example, static hydrodynamic reactor devices disclosed in U.S. Pat. Nos. 5,971,60; 6,502,979; 7,086,777; 7,207,712; 9,290,717; 9,410,109; 9,453,180; 9,556,399; 9,765,279 and 9,845,442 can be used for carrying out the disclosed method.

In one or more embodiments, the static hydrodynamic reactor can be a static hydrodynamic cavitation reactor having one or more local constrictions. For instance, the static hydrodynamic cavitation reactor can have 2, 3 or 4 local constrictions arranged in series. Preferably, the hydrodynamic cavitation reactor is a static device that produces cavitation by passive means. Examples of static cavitational energy sources that can be used to apply cavitational energy to the pressurized pretreated mixture include, but are not limited to, static mixers, orifice plates, perforated plates, nozzles, venturis, jet mixers, eductors, cyclonettes and control flow cavitation devices. In one example, the static hydrodynamic cavitation reactor can be an in-line device.

The static hydrodynamic cavitation reactor can form a hydrodynamic cavitation field in the pressurized pretreated mixture downstream of each local constriction in the reactor provided sufficient upstream pressure, for example, the pressures noted above. The hydrodynamic cavitation field can contain cavitation bubbles. In general, cavitation can be described as the generation, subsequent growth and collapse of cavitation bubbles and cavities. During the collapse of the cavitation bubbles, high-localized pressures and temperatures are achieved, with some estimations of 5000° C. and pressure of approximately 500 kg/cm$^2$ (K. S. Suslick, Science, Vol. 247, 23 Mar. 1990, pgs. 1439-1445). High temperatures and pressures can stimulate the progress of various chemical reactions which may not be possible under ordinary conditions, such as standard temperature and pressure, STP. Therefore, a material may undergo physical changes under the influence of cavitation energy. In the present invention, the cavitation conditions assist in inducing a neutralization reaction in the pressurized pretreated mixture.

The one or more local constrictions in the static hydrodynamic cavitation reactor can be an orifice, baffle, bluff body or nozzle. The orifice can be any shape, for example, cylindrical, conical, oval, right-angled, square, etc. Depending on the shape of the orifice, this determines the shape of the cavitation fluid jets flowing from the localized flow constriction. The orifice can have any diameter, for example, the diameter can be greater than 0.1, 0.2, 0.3, 0.4, 0.5, 0.6, 0.8, 1, 2, 3, 5, or 10 mm, and preferably more less than 2, 1.5, 1 or 0.8 mm. In one example, the diameter of the orifice can be about 0.3 mm, 0.4 mm or about 0.5 mm. For multistage cavitation, two or more local constrictions, such as an orifice, can be in series, for example at least 2, 3, 4 or 5 orifices can be in series arranged in the static hydrodynamic cavitation reactor.

The hydrodynamic cavitation field downstream of the local constriction is generated as the processing pressure of the pressurized pretreated mixture is reduced after passing through the local constriction. Maintaining a pressure differential across the local constriction allows control of the cavitation intensity in the static hydrodynamic cavitation reactor. The pressure differential across the local constriction is preferably at least 100, 125, 150, 170, 200, 300, 400, 500, 600, 700, 800, 850, 900, or 1000, psi. Velocity of pressurized pretreated mixture through the local constriction in the static hydrodynamic cavitation reactor is preferably at least 1, 5, 10, 15, 20, 25, 30, 40, 50, 60 or 70 meters per second (m/s). The pressure drop in the pressurized pretreated mixture can be measured across the static hydrodynamic cavitation reactor, which includes the pressure drop across all flow constrictions contained therein. The pressure drop in the pressurized pretreated mixture across the static hydrodynamic cavitation reactor can be in the range of 60 to 80 percent of the pre-determined inlet pressure to the reactor, or at least 65, 70 or 75 percent. In one embodiment, the pressure drop in the pressurized pretreated mixture across the static hydrodynamic cavitation reactor can be at least 100, 150, 200, 250, 300, 500 or 750 psi.

The cavitation bubbles formed by passing the feed supply 7 through the local constriction of the static hydrodynamic cavitation reactor are collapsed under the influence of static pressure. Energy emitted during collapse of the cavitation bubbles is directly proportional to magnitude of static pressure in surrounding liquid bubbles. Therefore, magnitude of the static pressure is directly related to energy emitted during cavitation bubbles collapse and better dispersion effect. The collapsing of the cavitation bubbles in the hydrodynamic cavitation field forms a reacted mixture having soaps from vegetable oil formed during the neutralization reaction. The base of the pressurized pretreated mixture reacts with free fatty acids and acid of the mixture. The reaction of the base having an OFF function group with the free fatty acids (e.g., stearic acid) having a $H^+$ functional group forms soaps, or salts of the fatty acids. These formed soaps are separated from the vegetable oil downstream of the reactor for providing a refined vegetable oil.

The pressurized pretreated mixture can be passed through the static hydrodynamic cavitation reactor described herein as a single pass process or a multi-pass process to subject the mixture to more than one hydrodynamic cavitation. For example, the steps of passing the mixture through the reactor forming a field of hydrodynamic cavitation bubbles and collapsing the bubbles can be repeated one, two, three or four times prior to transferring the reacted mixture to downstream separation operations. In one example, to create a multi-pass cavitation process the pressurized pretreated mixture can be recycled repeatedly through the reactor via a recirculation loop. Alternatively, two or more reactors can be positioned in series to produce a multi-pass cavitation process.

The purpose of base-induced neutralization of vegetable oil is to remove residual acid, free fatty acids, phosphatides and other materials including protein meal, glycerol, carbohydrates, resins and metals from the vegetable oil. At same time, due to the neutralization of free fatty acids as noted above, soaps (salts of free fatty acids) are formed in the vegetable oil, which further promote the formation of emulsions that may further facilitate secondary reactions in the oil, such as saponification of triglycerides.

Without being bound by any particular theory, it is believed that the using a low-shear pump to pressurize acid-treated vegetable oil can prevent formation of fine emulsions before the oil is later passed through a static hydrodynamic reactor, which allows the base solution and vegetable oil to remain in contact for minimal periods of time only in the reactor prior to the neutralization reaction and formation of soaps. Although a fine emulsion may be desirable for mixing of the acid with the non-hydratable phosphatides in the vegetable oil to decompose them, such fine emulsions can increase the amount of soaps formed during the neutralization reaction. Formation of more soaps can trap vegetable oil to reduce yield in the refining process and also increase the amount of soaps that need to be removed, which can increase processing time and cost. As compared to pressurizing the pretreated mixture with a high-shear pump, the use of a low-shear pump provides a mixture that can be processed in the static hydrodynamic reactor and reduce the amount of soaps in the reacted mixture. Under the conditions in the static hydrodynamic reactor, coupled with the pressurized pretreated mixture prepared with the use of a low-shear pump, soap formation and saponification of triglycerides can be reduced and the refined oil yield, due to the soapstock emulsifying effect, can be increased.

The reacted mixture is discharged from the static hydrodynamic reactor for further processing, for example, the vegetable oil in the reacted mixture can be separated from the soaps. In one or more embodiments, water can be added to the reacted mixture prior to separating soaps from the mixture. The reacted mixture exiting the reactor can be transferred into a vessel with a mixing chamber equipped with mixing means. Mixing means can include agitators, mixers, impellers or the like, for instance, an top-mounted impeller on a metal tank. The reacted mixture can be further mixed and retained in the vessel to further add water to the reacted mixture. The homogeneous reacted mixture can be maintained by mixing for a period of 5 minutes to 2 hours, 15 minutes to 1.5 hours, 20 minutes to 1 hour, or 25, 30, 35, 40, 45 or 50 minutes. The vessel can be jacketed or equipped with another heating apparatus, such as coils, for maintaining a desired holding temperature, for example, in the range of 20 to 100° C., or at least to 30, 40, 50, 60, 70, 80, 90 or 100° C.

Water can be added as a separate component to the reacted mixture, for example, the addition of water to the vessel storing the reacted mixture directly discharged from the static hydrodynamic reactor. In some embodiments, total water in the reacted mixture is made up an aqueous pH adjuster reagent (e.g., acid), and an aqueous base solution. After addition of a separate water source to the reacted mixture, the reacted mixture can contain water in the range of 1 to 20 weight percent, 1.5 to 15 weight percent, 2 to 12 weight percent, 2.5 to 10 weight percent, or 3, 3.5, 4, 4.5, 5, 6, 7, 8, or 9 weight percent based on the total weight of the vegetable oil in the stored reacted mixture. The water for addition to the reacted mixture can be stored in a working or holding tank prior to being added to the vegetable oil. In one or more embodiments, additional water can be added to the reacted mixture discharged from the static hydrodynamic reactor, for example, 0.1 to 3 weight percent, 0.2 to 2.5 weight percent, 0.3 to 2.0 weight percent, 0.4 to 1.5 weight percent or 0.5 to 1.0 weight percent based on the total weight of the vegetable oil discharged from the static hydrodynamic reactor.

The reacted mixture, whether discharged directly from the static hydrodynamic reactor or from the storage vessel after addition of water, can be further processed to prepare a refined vegetable oil product having a reduced amount of soaps and impurities. For example, the reacted mixture can be transferred to one or more separation phases to remove the added water, acid, base, soaps or other components or a portion thereof and impurities from the vegetable oil phase to create a refined vegetable oil product. Prior to separation, the reacted mixture can be passed through a heat exchanger, to bring the mixture to desired temperature (e.g., 40 to 70° C.) prior to being processes in a separator. The reacted mixture, containing a water phase and an oil phase, can be processed to separate the phases thereby removing soaps formed during the neutralization reaction (e.g., in the static hydrodynamic reactor).

Separation of the water phase from the oil phase can be done with a decanter, centrifuge, hydrocyclone or similar separation equipment. The differences in densities of water and oil allows for a rapid and distinct separation of the two components. For example, if the separator is a gravity tank with a mixer or agitator, the residence time can be selected to allow for gravitational separation of the heavy phase and light phase as desired. Separation temperatures in a separation vessel can be adjusted as desired, for example, the separation temperature can be in the range of 20° C. to 150° C., 30° C. to 100° C. or 40° C. to 80° C. Preferably, the water and oil mixture can be introduced into a separation vessel at a temperature in the range of 20° C. to 60° C. From the separator, a water phase containing gums and soaps and a refined or purified vegetable oil are formed. The refined vegetable oil can be subjected to further processing steps known in the art including bleaching or deodorizing, as may be necessary or desirable depending on the end use for which the oil product is intended.

The vegetable oil process disclosed herein optimizes conventional systems with the selective use of only a low-shear pump for pressurizing an acid-treated vegetable oil prior to carrying out a neutralization reaction in the static hydrodynamic reactor. The low-shear pump ensures a fine emulsion is not formed, which can lead to an increased formation of soaps in the static hydrodynamic reactor during the neutralization reaction. The vegetable oil refining methods disclosed can reduce the rate and amount of soaps formed during neutralization as compared to the use of high-shear pressurization device (e.g., a high-shear pump). For example, the vegetable oil refining methods of the present disclosure can reduce soap formation during a neutralization reaction of a pretreated vegetable oil by 10 to 75 percent, 20 to 70 percent, 30 to 65 percent, or 40 to 60 percent as compared to the soap formation of a system that utilizes a high-shear device to pressurize a pretreated mixture prior to carrying out a neutralization reaction.

The reaction of the present disclosure also enables a higher oil yield due to the formation of less soaps that can entrap vegetable oil that are separated in a water phase. The method of the present disclosure reduce the time and costs needed to complete or substantially complete the refining of vegetable oil, which can have significant positive impact on the overall economic value of refining process.

The method can be carried out at different temperatures. The method provided herein can be conducted at any temperature deemed suitable by one of ordinary skill in the art. In certain embodiments, the temperature during the process (e.g., neutralization step) can be in the range of 20-110, 30-100, 50-85, or 60-75° C. In certain other embodiments, the temperature during the process is about 20, 30, 40, 50, 60, 70, 80, 90, 100 or 120° C. The vegetable oil in the neutralization process is typically maintained at a temperature in the range of about 40° C. to 95° C.

The refined oil product resulting from separation of water and impurities or gums, such as soaps and phosphatides, has an improved quality. The soap content of the refined vegetable oil can be 200 ppm or less, 150 ppm or less, 125 ppm or less, 100 ppm or less, 90 ppm or less, or 80 ppm or less. In another example, the phosphorus content of the refined vegetable oil product can be less than 10 ppm, 8 ppm, 6 ppm, 5 ppm, or 4 ppm whereas the starting phosphatide or phosphorus content of the vegetable oil being fed to the static hydrodynamic reactor can be in the range of 200 to 1200 for crude oils and 30 to 200 for water degummed oils as discussed above.

In order to promote a further understanding of the invention, the following example is provided. These examples are shown by way of illustration and not limitation.

Example 1

Crude canola oil with a phosphorus content of 484 ppm, 0.62% FFA, 219 ppm calcium and 89 ppm magnesium was heated to a temperature of approximately 85° C. 672 ppm of concentrated (75 wt %) phosphoric acid was added to the crude canola oil, followed by 45 minutes mixing with speed of 350 rpm, to form an acid-treated vegetable oil.

0.19 ppm caustic soda (75 wt % concentrated) was then added to the acid-treated canola oil (no retention time) to obtain a pre-treated oil mixture. The pre-treated oil mixture was pressurized by either passing it through a low-shear reciprocating plunger pump or a high-shear multistage centrifugal pump to form two pressurized pretreated mixtures. Each pressurized pretreated mixture at 900 psi was passed once through two hydrodynamic cavitation reactors arranged in series (a first and second cavitation reactor having a local constriction). The reacted oil mixture was then directly fed to a vessel equipped with a stirrer and 2 weight percent of deionized water was added to the cavitated and reacted oil mixture with mixing at 80° C. for a period of 20 minutes retention time. The water-added reacted mixture samples were centrifuged for separation of the soapstock, etc. from the vegetable oil to prepare a refined vegetable oil product.

Soaps, phosphorus, free fatty acids, calcium and magnesium content of the refined vegetable oils were determined from analysis of the light phase from centrifugation. The results are shown in Table 1.

TABLE 1

| Pump | Soap (ppm) | FFA (%) | Phosphorus (ppm) | Ca (ppm) | Mg (ppm) |
|---|---|---|---|---|---|
| Low shear reciprocating plunger pump | 90 | 0.20 | 6.0 | 0 | 0 |
| High shear multistage centrifugal pump | 243 | 0.24 | 5.7 | 1.4 | 0.6 |

As can be seen in Table 1, the soap formation can be lowered by at least about 63% by using a low-shear reciprocating pump as compared to the high-shear centrifugal pump. The soap content of the refined vegetable oil can be lowered to 90 ppm or less using a low-shear reciprocating pump as compared to the high-shear centrifugal pump.

Similarly, the free fatty acids, calcium and magnesium content in the vegetable oil can be lowered by using a low-shear reciprocating pump as compared to the high-shear centrifugal pump. For instance, the free fatty acids can be lowered to 0.20 or less, or about 17% less as compared to the use of a high-shear centrifugal pump. The calcium and magnesium content in the vegetable oil can be respectively lowered by 1.4 and 0.6 ppm, or 100% less as compared to the use of a high-shear centrifugal pump.

Table 1 further shows that the method of the present disclosure can result in a refined vegetable oil having an essentially equal phosphorus content as a process using a high-shear centrifugal pump. For example, the phosphorus content of the refined vegetable oil produced with the method utilizing the low-shear reciprocating pump was within 0.3 ppm phosphorus, or about within 5 percent, of the phosphorus content of a refined vegetable oil produced with the high-shear centrifugal pump.

It will be understood that this invention is not limited to the above-described embodiments. Those skilled in the art having the benefit of the teachings of the present invention as hereinabove set forth, can effect numerous modifications thereto. These modifications are to be construed as being encompassed with the scope of the present invention as set forth in the appended claims.

What is claimed:

1. A method for reducing soap formation during refining of a vegetable oil, the method comprising:

a. mixing an acid-treated vegetable oil with a base to neutralize free fatty acid and acid in the acid-treated vegetable oil to form a pretreated mixture;

b. passing the pretreated mixture through a low-shear pump operating at a shear rate of less than 2,500 $s^{-1}$ to increase pressure in the pretreated mixture to form a pressurized pretreated mixture; and c. forming a reacted mixture by passing the pressurized pretreated mixture through a static hydrodynamic reactor to induce a neutralization reaction in the pressurized pretreated mixture, the neutralization reaction forms soaps in the reacted mixture, the soaps being present in the reacted mixture at less than 200 ppm.

2. The method of claim 1, wherein the soap formation during the neutralization reaction of the pressurized pretreated mixture is 20 to 75 percent less as compared to soap formation with a high-shear pump operating at a shear rate of 5,000 $s^{-1}$ or more in place of the low-shear pump.

3. The method of claim 1, wherein the static hydrodynamic reactor is selected from a group consisting of a high-pressure jet nozzle, a static mixer, a high-pressure valve type homogenizer, a hydrodynamic cavitation reactor and a compression-decompression device.

4. The method of claim 1, wherein the acid-treated vegetable oil is an acid-treated crude vegetable oil or an acid-treated water-degummed vegetable oil.

5. The method of claim 1, wherein the acid in the acid-treated vegetable oil is selected from the group consisting of phosphoric acid, hydrochloric acid, sulfuric acid, ascorbic acid, acetic acid, citric acid, fumaric acid, maleic acid, tartaric acid, succinic acid, glycolic acid and a combination thereof.

6. The process of claim 1, wherein the base is an aqueous base selected from the group consisting of sodium hydroxide, potassium hydroxide, sodium silicate, sodium carbonate, calcium carbonate and a combination thereof.

7. The method of claim 1, wherein the vegetable oil in the acid-treated vegetable oil is selected from the group consisting of acai oil, almond oil, babassu oil, blackcurrent seed oil, borage seed oil, canola oil, cashew oil, castor oil, coconut oil, coriander oil, corn oil, cottonseed oil, crambe oil, flax seed oil, grape seed oil, hazelnut oil, hempseed oil, jatropha oil, jojoba oil, linseed oil, macadamia nut oil, mango kernel oil, meadowfoam oil, mustard oil, neat's foot oil, olive oil, palm oil, palm kernel oil, palm olein, peanut oil, pecan oil, pine nut oil, pistachio oil, poppy seed oil, rapeseed oil, rice bran oil, safflower oil, sasanqua oil, sesame oil, shea butter, soybean oil, sunflower seed oil, tall oil, tsubaki oil, walnut oil and a combination thereof.

8. The method of claim 1, wherein the acid-treated vegetable oil is at a temperature in the range of 50 to 100° C.

9. The method of claim 1, wherein the static hydrodynamic reactor comprises an inline device.

10. The method of claim 1, wherein the static hydrodynamic reactor is a static hydrodynamic cavitation reactor comprising a local constriction.

11. The method of claim 10, wherein the local constriction is an orifice.

12. The method of claim 10, wherein the static hydrodynamic cavitation reactor comprises a first local constriction in series with a second local constriction.

13. The method of claim 1, wherein the neutralization reaction forms soaps in the pressurized pretreated mixture and the soaps are separated from the pressurized pretreated mixture to form a refined vegetable oil.

14. The method of claim 13, the refined vegetable oil comprises less than 100 ppm of the soaps formed by the neutralization reaction.

15. A method for reducing soap formation during refining of a vegetable oil, the method comprising:

a. mixing an acid-treated vegetable oil with a base to neutralize free fatty acid and acid in the acid-treated vegetable oil to form a pretreated mixture;

b. passing the pretreated mixture through a low-shear pressurizing device operating at a shear rate of less than 2,500 $s^{-1}$ to increase pressure to greater than 750 psi in the pretreated mixture to form a pressurized pretreated mixture;

c. forming a reacted mixture by passing the pressurized pretreated mixture through a two or more local constrictions in series, each local constriction generates cavitation in the pressurized pretreated mixture to induce a neutralization reaction in the pressurized pretreated mixture, the neutralization reaction forms soaps in the pressurized pretreated mixture;

d. adding water to the reacted mixture; and e. separating the soaps from the reacted mixture to form a refined vegetable oil, the refined vegetable oil comprising less than 200 ppm of the soaps.

16. The method of claim 15, wherein the pressurized pretreated mixture is at a temperature in the range of 50 to 100° C.

17. The method of claim 15, wherein a static hydrodynamic cavitation reactor comprises the two or more local constrictions.

18. The method of claim 15, wherein the soap formation during the neutralization reaction of the pressurized pretreated mixture is 20 to 75 percent less as compared to soap formation with a high-shear pump operating at a shear rate of 5,000 $s^{-1}$ or more in place of the low-shear pump.

19. The method of claim 15, wherein the reacted mixture comprising the water is mixed for 15 minutes or more prior to separating the soaps from the reacted mixture.

20. The method of claim 15, wherein the low-shear pressurizing device is selected from a group consisting of a reciprocating positive displacement pump, a piston pump, a plunger pump and a diaphragm pump.

* * * * *